United States Patent [19]

DuHamel

[11] 4,315,264

[45] Feb. 9, 1982

[54] CIRCULARLY POLARIZED ANTENNA WITH CIRCULAR ARRAYS OF SLANTED DIPOLES MOUNTED AROUND A CONDUCTIVE MAST

[76] Inventor: Raymond H. DuHamel, 12001 Rhus Ridge Rd., Los Altos Hills, Calif. 94022

[21] Appl. No.: 95,051

[22] Filed: Nov. 16, 1979

Related U.S. Application Data

[63] Continuation-in-part of Ser. No. 885,444, Mar. 10, 1978, abandoned.

[51] Int. Cl.[3] ..... H01Q 21/26

[52] U.S. Cl. ..... 343/797; 343/798; 343/890

[58] Field of Search ..... 343/796, 797, 800, 804, 343/798, 890

[56] References Cited

U.S. PATENT DOCUMENTS

| | | | |
|---|---|---|---|
| 2,539,433 | 1/1951 | Kandoian | 343/800 |
| 2,703,840 | 3/1955 | Carmichael | 343/804 |
| 4,083,051 | 4/1978 | Woodward | 343/797 |

*Primary Examiner*—Eli Lieberman

*Attorney, Agent, or Firm*—Flehr, Hohbach, Test

[57] ABSTRACT

An antenna including a conductive support mast serving to support one or more bays of circular arrays of dipole assemblies around and spaced from the mast. Each dipole assembly consists of at least two dipoles connected in parallel. The lengths and angles of the dipoles with respect to a plane perpendicular to the support mast are adjusted and the dipole assemblies are fed so as to provide circularly polarized radiation broadside to the antenna.

8 Claims, 17 Drawing Figures

CIRCULARLY POLARIZED ANTENNA WITH CIRCULAR ARRAYS OF SLANTED DIPOLES MOUNTED AROUND A CONDUCTIVE MAST

This application is a continuation-in-part of my copending application Ser. No. 885,444 filed Mar. 10, 1978, entitled "Circularly Polarized Antenna With Circular Arrays of Slanted Dipoles Mounted Around a Conductive Mast", and abandoned.

This invention relates generally to circular arrays of dipoles mounted around a conducting support and particularly to circularly polarized circular arrays of dipoles and more particularly to such antennas for FM and TV broadcast applications.

As used herein, the term "circularly polarized antenna" is used to refer to the general class of elliptically polarized antennas with a low axial ratio.

Circular arrays of dipoles placed around a conducting mast or cylinder are known. U.S. Pat. No. 2,303,611 issued to P. S. Carter describes horizontal dipoles placed around a conducting cylinder and fed in phase to produce a horizontally polarized signal for TV broadcast applications. U.S. Pat. No. 2,533,900 issued to J. P. Shanklin describes vertical folded dipoles placed around a conducting cylinder to produce an omnidirectional radiation pattern with vertical polarization.

Abel et al. in the IEEE Transactions on Broadcasting, Vol. BC-13, No. 3, July 1967, describes an FM antenna mounted on the Empire State Building consisting of two bays of sixteen slanted dipoles placed around a conducting cylinder with a circumference of approximately ten wavelengths. They excited the dipoles in modes one and four (as defined below) in order to achieve cancellation of the reflected waves and thus a low VSWR. They ended up using mode one and achieved azimuth patterns that were omnidirectional within only ±4 db. The polarization was "elliptical with one large and one small axis" which means that it was essentially linear polarization. As taught in this disclosure, it would be necessary to use about 32 dipoles excited in mode fourteen to achieve a good omnidirectional pattern with circular polarization.

Circular arrays of slanted dipoles placed around circular cylinders have been used in military surveillance. However, these have been fed in a beam co-phasal excitation which produces a narrow azimuth beam with slant linear polarization.

The antennas of the above citations all provide linear polarization. A variety of approaches may be used to obtain omnidirectional coverage with circular polarization from a circular array of radiating elements.

One approach is to use unidirectional circularly polarized radiating elements with the azimuth beamwidth of and the number of radiating elements adjusted to give omnidirectional coverage. An example is to use crossed dipoles placed in a cylindrical cavity as the radiating elements following Fisk & Donovan, IEEE Transactions on Broadcasting, Vol. BC-22, No. 3, September 1976. Crossed dipoles placed in front of a flat reflecting screen have also been used.

Another approach is to superimpose a vertically polarized circular array of elements with a horizontally polarized array of elements. O. Ben-Dov in the IEE Transactions on Broadcasting, March 1976, pp. 1-5, describes a circularly polarized antenna consisting of bays of four vertically polarized V-dipoles interleafed between bays of four horizontally polarized batwing antennas. The antennas in each bay are fed with a phase progression of 90° which corresponds to mode M=1 as defined and used in the description to follow. Separate horizontal and vertical dipoles are used to produce circular polarization. The horizontal polarization is obtained from radial monopole type antennas rather than the circumferential component of a slanted dipole as described herein. Circular polarization is obtained by adjusting the power split between and relative phasing of the vertically and horizontally polarized arrays. Other examples are given by W. Sichak et al., U.S. Pat. No. 2,631,237 and A. G. Kandoian, U.S. Pat. No. 2,539,433 where the vertically polarized and horizontally polarized radiators are combined at each radiating element. It is necessary to make a critical adjustment in the coupling of the two radiators so as to achieve equal radiated power and correct relative phasing for the vertically and horizontally polarized radiators.

Still another approach is to use a circular array of nonunidirectional linearly polarized radiating elements. U.S. Pat. No. 2,217,911 to N. E. Lindenblad describes a circular array of slanted dipoles placed around a conducting support to produce circular polarization. The dipoles are slanted at an angle of 45° and are fed in phase. G. H. Brown and O. M. Woodward, Jr. in the RCA Review, June 1947, pp. 259-269 generalize Lindenblad's concept and show how the slant or pitch angle of the dipole should be varied with array diameter to obtain circular polarization. In all cases the dipoles were fed in phase with equal magnitudes which corresponds to mode M=0.

U.S. Pat. No. 2,512,137 to L. Buchwalter et al. describes an array of slanted or curved dipoles placed around a conducting cylinder to provide equal reception for vertically and horizontally polarized signals. The dipoles are slanted at an angle of 45°. The curved dipoles were restricted to be on the surface of a cylinder so that they were actually portions of a helix. This antenna differed from Lindenblad's mostly in the manner of feeding the dipoles.

Lindenblad's approach was generalized to the case of higher order modes (M not equal to zero) by O. M. Woodward, U.S. Pat. No. 4,083,051. Woodward pointed out that the vertial support mast currents for Mode M=0 severely degrade the axial ratio and that the support mast currents are much less for the higher order modes. This is theoretically verified below. Woodward states that the slant angle should be about 36°. As shown below, the optimum slant angle is a function of the mode number and diameter of the circular array and is much different than 36° for many cases.

For small mast diameters and modes other than zero, the mast currents are indeed negligible and hence excellent circular polarization (axial ratio less than 2 db) is obtained by the use of slanted linear dipoles. (For impedance matching purposes the dipoles are usually made one-half wavelength long.) Of course the polarization of a linear dipole is linear. For larger mast diameters the mast currents are not negligible and produce a larger and undesirable axial ratio.

A. Alford, U.S. Pat. No. 4,031,536, describes an elliptically polarized antenna which uses non-unidirectional twin-Z radiating elements in a circular array for mode zero only. The twin-Z elements are also elliptically polarized and have a large axial ratio. Alford claims axial ratios of 10 db and 4.5 db for two and three element arrays. This is not satisfactory for television service. Furthermore, he does not teach how to obtain a low axial ratio of 1 or 2 db. Perhaps this is why he calls it an elliptically polarized antenna rather than a circularly polarized antenna.

Each half of the twin-Z radiating element consists of a Z-shaped element with the central portion being horizontal with a length of $L_h$ and two vertical portions pointing in opposite directions, each with a length of $L_v$. The total length, $L_z$, of the Z is then $L_h+2L_v$. The central portion and the outermost vertical portion is approximately equivalent to a slant monopole with a slant angle, $\psi$, equal to $\tan^{-1}(L_v/L_h)$ and a length of $L_h+L_v$. Thus the twin-Z element is approximately equivalent to a slant dipole connected in parallel with a vertical dipole of length $2L_v$. However, Alford restricts the length $L_z$ of the Z element to be about 0.5 wavelengths with the central portion length $L_h$ being about 0.25 wavelengths and the vertical portion lengths $L_h$ being about 0.125 wavelengths. The equivalent pitch angle $\psi$ is 26°. The total length of the twin-Z radiating element is then one wavelength. It will be shown that these restrictions do not lead to optimum designs.

It is an object of the present invention to provide an antenna including a circular array of slanted dipoles placed around a conducting support mast for radiating circularly polarized electromagnetic waves for any diameter of the support mast.

It is another object of the present invention to provide a high gain omnidirectional antenna for radiating circularly polarized electromagnetic waves in a broadside direction over moderate frequency bands.

It is another object of the present invention to provide circularly polarized broadcast television antennas which greatly improve the quality of television reception.

In one embodiment of the invention a circular array of non-unidirectional elliptically polarized radiating elements is used with the axial ratio of the radiating element, but not the array, being large. The radiating element may take the form of a slanted half-wave dipole and a short vertical dipole connected in parallel to it. The slant angle of the half-wave dipole is approximately set to give minimum axial ratio for the circular array without the vertical dipoles. The length of the vertical dipoles is adjusted to reduce the axial ratio to a low value. Axial ratios less than 2 db may be achieved for larger mast diameters. The vertical dipole length is usually much less than a half-wavelength.

From the above discussion it is apparent that there are a variety of approaches for obtaining circular polarization. The preferred approach is the one giving the required electrical performance at minimum cost. Since wind loading is a very important cost factor for tower mounted antennas it is apparent that the simplest antenna approach with the minimum amount of material is the preferred one. Now the number of radiating elements in the circular array depends only on the array diameter, mode number and circularity as described below and not on the type of radiating element. Thus the radiating element with the least wind loading should be the preferred one. It will be seen that this is the slant dipole or the slant dipole combined with a short dipole.

The foregoing and other objects of the invention are achieved by an antenna comprising a support having a conductive outer surface and one or more bays of circular arrays of three or more dipole assemblies placed around the support with the dipole assemblies fed with voltages of equal amplitude and progressive phase shift of $2\pi M/N$ radians where M, an integer, is the mode number and N is the number of dipole assemblies in the circular array. Each dipole assembly (or radiating element) consists of one or more slanted dipoles with different slant angles and connected in parallel, i.e., fed with equal voltages.

Figure 1:
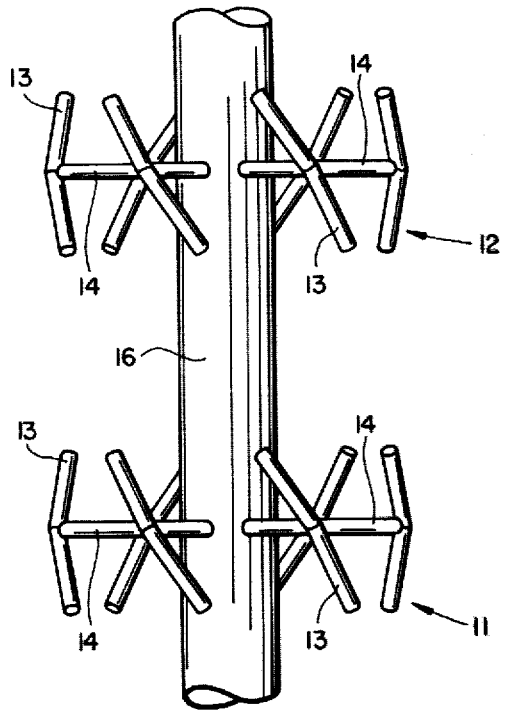
FIG. 1 shows two bays of a six element circular array of slanted dipoles mounted around a conducting cylinder.

An antenna in accordance with an embodiment of the invention is shown in FIG. 1. It consists of two bays 11, 12 of six simple slanted dipoles 13 in a circular array. The dipoles are supported by horizontal members 14 connected to a vertical conductive support mast 16. Baluns (not shown) are enclosed within the horizontal members 14 in order to provide balanced excitation of the dipoles 13. The dipoles are slanted at an angle, as shown and to be presently described in detail, with respect to the horizontal in order to produce circularly polarized radiation. In this case the dipoles are bent back so that the center and tips of the dipole lie on the surface of a common cylindrical surface having its axis coincident with the axis of the mast. This is not a necessary condition since linear dipoles will also produce circular polarization. In the embodiment shown, the feed network, to be described, which provides power to the dipoles is designed such that the dipoles of each bay are excited with voltages of equal magnitude and with phases that progress 120° from one dipole to the next. As will be described, this corresponds to a mode two antenna.

To generalize, each bay may consist of N slanted dipole assemblies 13 which are spaced around the conductive support 16 and are excited with voltages of substantially equal magnitude and with phases which depend upon the mode number, M, an integer, and N, the number of dipoles in the circular array. The analysis to follow will show how the phases are specified.

Figure 2:
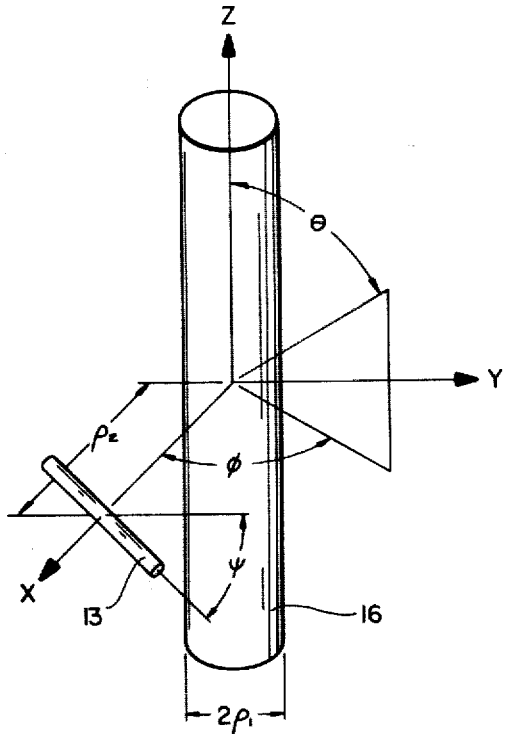
FIG. 2 shows a single slanted dipole near a cylinder and defines the coordinate system used in analyzing the radiation pattern of the dipole.

FIG. 2 shows a single dipole of a circular array of N slanted dipoles supported around a conducting cylinder for achieving circular polarization. The dipoles are placed on a circle of radius $\rho_2$ and the cylinder radius is $\rho_1$. The slant angle $\psi$, with respect to the horizontal, of the dipole 13 and the spherical coordinate system are shown in FIG. 2. It is, of course, apparent that the conducting cylinder may be replaced by a support of other configuration. In the explanation to follow $\rho_1$ shall mean the radius of a cylinder which contacts the outermost portions of the support. For equally spaced dipoles the dipoles are excited so as to have currents of substantially equal magnitude and with phases which depend on the mode number M and N. The currents in the dipoles are given by.

$$I_n = e^{j2\pi Mn/N},\ n-1,2\ldots N \tag{1}$$

The total phase shift around the array is $2\pi M$ radians. It will be shown in the following paragraphs that elliptical polarization with a low axial ratio may be obtained for a given $\rho_1$ by a careful selection of M,N,$\rho_2$ and $\psi$.

The radiation pattern of a single bay may be expressed in terms of the vertical and horizontal components of the current in each dipole, $$I_{n,Z} = \sin\psi\ e^{j2\pi Mn/N} \tag{2}$$

$$I_{n,\phi} = \cos\psi\ e^{j2\pi Mn/N} \tag{3}$$

The $E_{74}$ component of the radiation pattern of the vertical current element located at $\rho=\rho_2$, $\phi_n$, $Z=0$ may be written as derived by Carter in the article entitled "Antenna Arrays Around Cylinders", Proc. I.R.E., Vol. 31, No. 12, pp. 671-693, December 1943.

$$E_\theta = \sin\theta\ \sin\psi\ e^{j2\pi Mn/N} \sum_{s=-\infty}^{\infty} (j)^s \left[ J_s(w_2) - J_s(w_1)\frac{H_s^{(2)}(w_2)}{H_s^{(2)}(w_1)} \right] e^{js(\phi-\phi n)} \tag{4}$$

where $w_1 = \beta\rho_1 \sin\theta$ $w_2 = \beta\rho_2 \sin\theta$ $J_s(w)$ is a Bessel Function of the First Kind $N_s(w)$ is a Bessel Function of the Second Kind $H_s^{(2)}(w) = J_s(w) - jN_s(w)$ $\phi_n = 2\pi n/N$ $\beta = 2\pi/\lambda$ $\lambda$ = wavelength Similarly, the $E_{74}$ and $E_\phi$ components of the horizontal component at the same location are given by $$E_\theta = \frac{\cos\theta\ \cos\psi}{w_2}\ e^{j2\ Mn/N} \sum_{s=-\infty}^{\infty} s(j)^s \left[ J_s(w_2) - J_s(w_1)\frac{H_s^{(2)}(w_2)}{H_s^{(2)}(w_1)} \right] e^{js(\phi-\phi n)} \tag{5}$$

-continued $$E_\phi = j\cos\psi e^{j2\pi Mn/N} \sum_{s=-\infty}^{\infty} (j)^s \left[ J_s'(w_2) - J_s'(w_1)\frac{H_s^{(2)'}(w_2)}{H_s^{(2)'}(w_1)} \right] e^{js(\phi-\phi n)} \tag{6}$$

where the primes represent derivatives with respect to the arguments. These expressions are exact for short dipoles and are fairly accurate for half wavelength dipoles. If there is no conducting cylinder present, then the second terms in the brackets in the above equations vanish. The total pattern is obtained by summing over the N elements. Thus, for the vertical component we may write $$E_\theta = \sin\theta\ \sin\psi \sum_{s=-\infty}^{\infty} (j)^s \left[ J_s(w_2) - J_s(w_1)\frac{H_s^{(2)}(w_2)}{H_s^{(2)}(w_1)} \right] e^{js\phi} \sum_{n=1}^{N} e^{j\frac{2\pi n}{N}(M-s)} \tag{7}$$

where the order of summations has been interchanged. The last summation term is non-zero only when $$s = M - kN$$

where k is an integer. Thus equation (7) may be written as $$E_\theta = \sin\theta\ \sin\psi \sum_{k=-\infty}^{\infty} (j)^{M-kN} \left[ J_{M-kN}(w_2) - J_{M-kN}(w_1)\frac{H_{M-kN}^{(2)}(w_2)}{H_{M-kN}^{(2)}(w_1)} \right] e^{j(M-kN)\phi} \tag{8}$$

Similar expressions may be derived for the fields of the horizontal component of the current.

In order to obtain an omnidirectional azimuth pattern there must be only one dominant term in the series of equation (8). The mode number M is chosen such that $|M| < N/2$. Thus the desired dominant term in equation (8) is $k=0$. To determine how many dipoles, N, are required to obtain an omnidirectional pattern, consider the simplified case where the cylinder is absent. It will become evident that the results with a cylinder are approximately the same. For M positive, the two lartest terms in equation (8) are $$E_\theta = \sin\theta\ \sin\psi\ [j^M J_M(w_2) e^{jM\phi} + j^{(M-N)} J_{M-N}(w_2) e^{j(M-N)\phi}]$$

Now, the magnitude of $J_s(w)$ decays quite rapidly as $|s|$ is increased beyond w. In order to achieve a good omnidirectional azimuth pattern the second term in the brackets should be small compared to the first. Let us define the circularity, C, of the azimuth pattern as $$C = 20 \log_{10} \left[ \frac{J_M(w_2) + J_{M-N}(w_2)}{J_M(w_2) - J_{M-N}(w_2)} \right] \quad (9)$$

This is the ratio of the maximum field to the minimum field in the azimuth pattern. A perfect omnidirectional pattern corresponds to C equal to zero db. This expression was evaluated for a large number of combinations of M, N and $w_2$. Using linear regression techniques the following expression for the number of dipoles was derived (broadside radiation);

$$N \geqq 2.1 + 2.25M - 0.25(CM/w_2) \quad (10)$$

This equation is accurate for $1.3 \geqq w_2/M \geqq 0.8$. As will be apparent later, this is the practical range for $w_2/M$. The upper limit is imposed to keep the slant angle from approaching zero and the lower limit is imposed to assure a reasonable spacing (0.1 to 0.25 wavelengths) of the dipoles from the cylinder. For small values of C the number of dipoles is insensitive to $w_2/M$. Woodward, U.S. Pat. No. 4,083,051, does not teach how to determine the minimum number of dipoles. In fact his mode two experimental model uses eight dipoles whereas equation (10) shows that six dipoles are sufficient for a two db circularity.

Assume now that N has been chosen large enough so that the higher order terms of equation (8) and a similar equation for $E_{100}$ may be neglected, i.e., only the $k=0$ term is retained. Then it may be shown that $$\frac{E_\theta}{E_\phi} = j \left[ \frac{\sin\theta \sin\psi + M \cos\theta \cos\psi / w_2}{\cos\psi} \right] G \quad (11)$$

where we have summed equations derived from (4) and (5) to obtain the total $E_\theta$. The factor G is given by $$G = \frac{H_M^{(2)'}(w_1)}{H_M^{(2)}(w_1)} \left[ \frac{J_M(w_2)N_M(w_1) - J_M(w_1)N_M(w_2)}{J_M'(w_2)N_M'(w_1) - J_M'(w_1)N_M'(w_2)} \right] \quad (12)$$

In order to achieve circular polarization, equation (11) must equal either j or −j. For a given $w_1$ and $w_2$, equation (12) has a certain magnitude. Then we may adjust the pitch angle $\psi$ so that the magnitude of equation (11) is one. (Note that the bracketed term of (11) reduces to $\tan\psi$ for broadside radiation). The bracketed terms of equations (11) and (12) are both real. Thus if the phase of $$\frac{H_M^{(2)'}(w_1)}{H_M^{(2)}(w_1)}$$

is 0° or 180° then the phase of $E_\theta/E_\phi$ is 90° or −90° which is correct for the circular polarization. If the phase is not 0° or 180° then we will have elliptical polarization with a minimum axial ratio which depends on this phase error. It may be shown that the phase of this ratio is given by $$\phi_c = \tan^{-1} \left[ \frac{2}{\pi w_1 [J_M(w_1)J'_M(w_1) + N_M(w_1)N_M'(w_1)]} \right] \quad (13)$$

Figure 3:
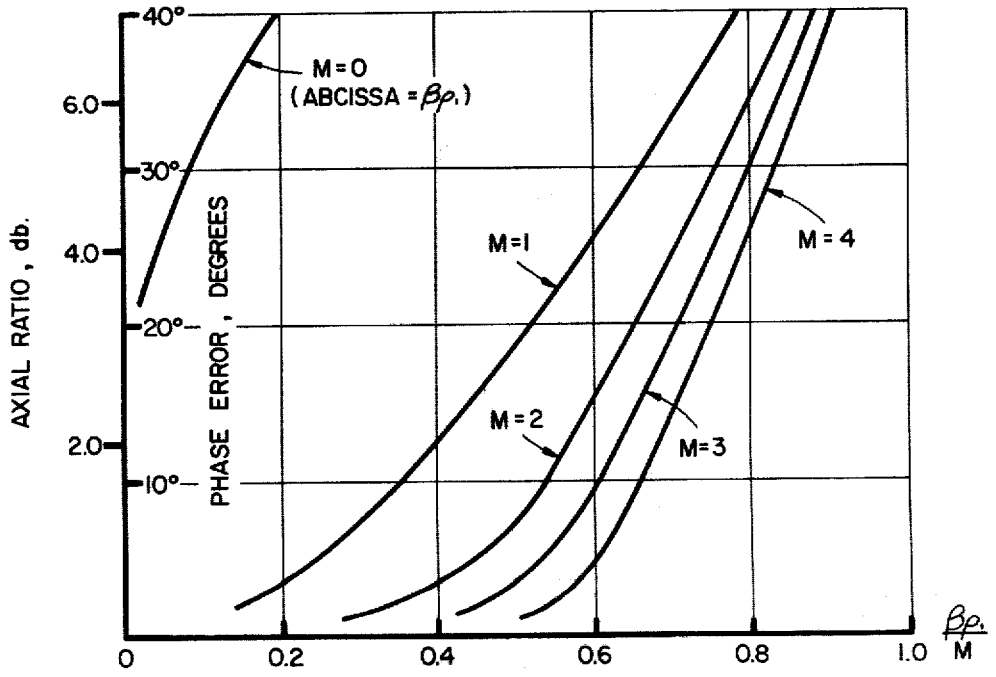
FIG. 3 shows the phase error and minimum axial ratio for a circular array of slanted dipoles versus the cylinder diameter for several modes.

FIG. 3 shows the phase error and minimum axial ratio versus $\beta\rho_1/M$ for modes 0 through 4. For mode 0, the cylinder diameter must be less than about 0.03λ in order to have a low axial ratio. This is certainly not practical for broadcast towers. With N=4, the M=0 mode is the Lindenblad antenna. For most of the Lindenblad antennas, the support tower extends only to the middle of the array. Thus the degradation of axial ratio would be less severe than that for a cylinder extending throughout the array. These theoretical results confirm Woodward's conclusion that the mast currents will seriously degrade the axial ratio for a mode zero slant dipole array (Lindenblads) but will have a much smaller effect for the higher order modes. The theory also gives us qualitative results for this effect.

For television broadcast applications it is desired that the axial ratio be less than three db and preferably less than two db. Consequently we should choose the mode number for a given $\beta\rho_1$ such that the minimum axial ratio as determined from equation (13) is somewhat less than the desired axial ratio because there may be additional amplitude and phase errors in the ratio $E_\theta/E_\phi$. Using linear regression curve fitting techniques, it is found from equation (13) that M must satisfy the following:

$$M \geqq 0.8 - 0.13AR + (1.47 - 0.09AR)\beta\rho_1 \quad (14)$$

where AR is the axial ratio in db. Of course, M is usually the minimum integer greater than the number on the right hand side. Thus the mode number may be selected once the cylinder diameter and axial ratio has been specified. Woodward does not teach how to choose the mode number. As an example, consider a channel 2 antenna with a height of six wavelengths. A wind loading analysis indicate the mast diameter will be 20 inches, for which $\beta\rho_1 = 0.304$. If we specify an axial ratio of 0.5 db, we find from (14) that $M \geqq 1.17$, i.e., we would have to use mode 2. If we relaxed the axial ratio requirement to 1.6 db then we could use mode 1.

We have now determined the number of radiating elements and the minimum mode number for the Woodward (and Lindenblad) circular array of slant dipoles. The dipole lengths are chosen to be about one-half wavelength for television broadcast applications because of the low VSWR and wind loading specifications. This provides the simplest and best type of circularly polarized broadcast antenna since each radiating element consists of only a single half-wave dipole. The other approaches discussed previously require either two half-wavelength dipoles or a twin-Z with a wavelength of radiating rods for the radiating element. Thus the wind loading of the slant dipoles is about one-half of that for the other approaches.

Now that we have determined the mode number for achieving a specified axial ratio we turn to the problem of determining the slant angle $\psi$ for minimum axial ratio. For TV and FM broadcast applications we are interested in essentially broadside radiation. Thus equation (11) may be reduced to give $$E_\theta/E_\phi = jG \tan\psi \quad (15)$$

Figure 5:
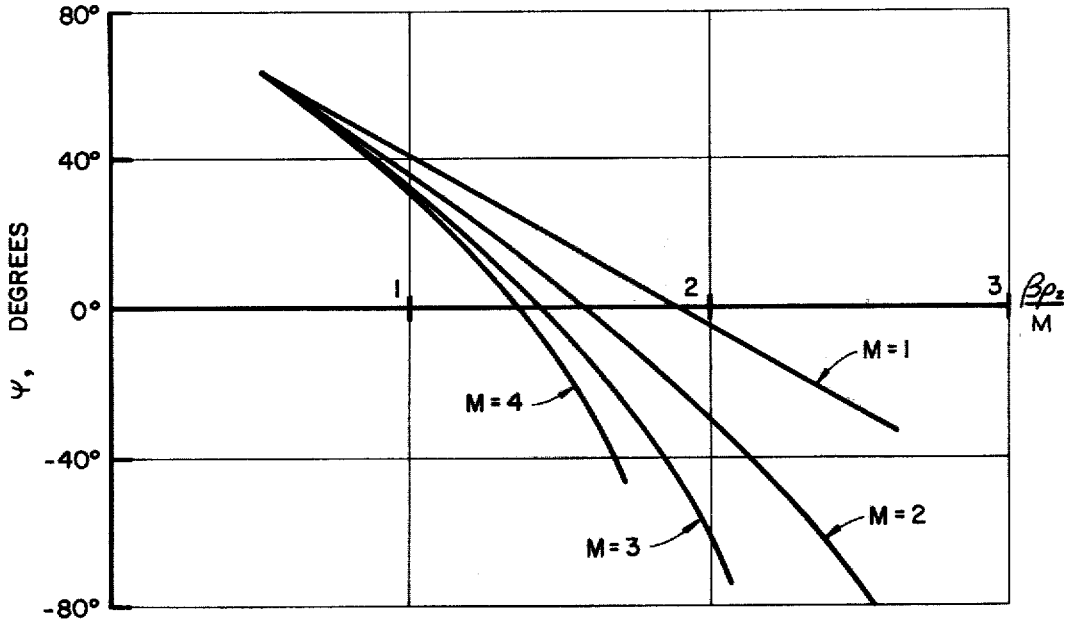
FIG. 5 shows the required pitch angle of the slanted dipoles for circular polarization with no support mast for several modes.

Thus we may calculate $|G|$ for a given $\rho_1$ and $\rho_2$ and then determine $\psi$ to give $|E_\theta/E_\phi| = 1$. This is the best we can do for simple dipoles. Short dipoles may be added as described below to reduce the axial ratio. FIG. 5 shows the results for the case of no cylinder wherein the slant angle $\psi$ is plotted versus $\beta\rho_2/M$ for modes zero to four. Slant angles near zero should be avoided since small alignment errors could lead to large axial ratios. $\psi=0$ is a singular point where the polarization is horizontal.

The sense of the elliptical polarization may be changed by tilting the dipoles in the opposite manner, i.e., by changing the sign of $\psi$.

Figure 6:
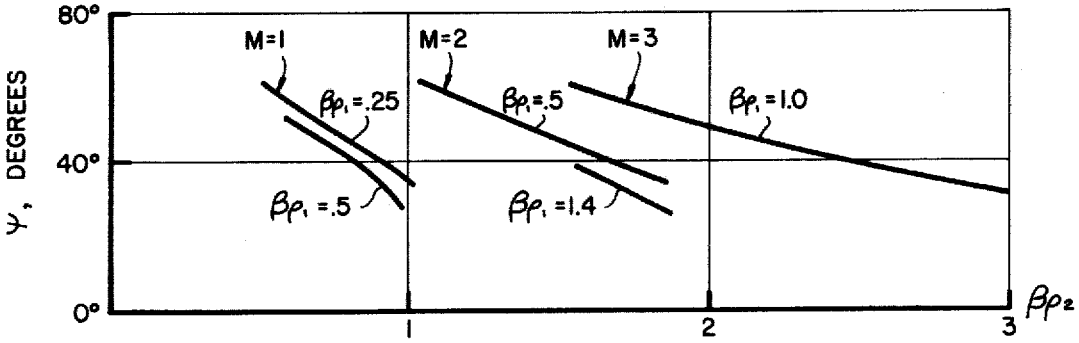
FIG. 6 shows the optimum slant angle for low axial ratio for several modes and cylindrical support diameters.

FIG. 6 shows the slant angle versus $\beta\rho_2$ for several modes and cylinder diameters. It was concluded from these and other calculations that the optimum slant angle is insensitive to cylinder diameter so long as the cylinder diameter is restricted to produce a small phase error as given by equation (13). The reason for this is as follows. Modes different than 0 produce null fields on the axis of the array. The extent of the null region increases with mode number. In other words, the field of the circular array is like a waveguide mode below cutoff in the interior region of the array. However, for larger cylinder diameters the presence of the cylinder may change the optimum slant angle by 5° to 10°. If this were not taken into account the axial ratio would be increased by 1.6 to 3.1 db. Thus it is best to use the accurate formula for calculating $\psi$, i.e., $$\psi=\tan^{-1}|1/G| \tag{16}$$

where G is defined by equation (12).

Woodward simply states that the pitch angle should be about 36°. It can be seen from the above results that this is accurate only for a certain combination of $\beta\rho_1$, $\beta\rho_2$ and mode number. For other combinations the optimum pitch angle could be much different which would produce a large axial ratio.

Figure 4:
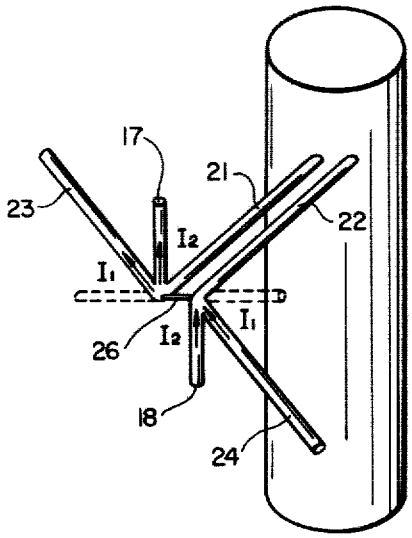
FIG. 4 shows a single slanted dipole with a short shunt vertical dipole.

The above analysis was applied to the case of simple linear slant half-wavelength dipoles. We could use crossed half-wavelength dipoles fed independently to provide a low axial ratio. However, this doubles the feed points, the feed harness and the wind loading. It is a purpose of this invention to minimize the number of dipoles, the feed points and the wind loading so as to minimize the cost. The degradation of the axial ratio due to the size of the cylinder may be reduced by adding a shorter dipole in the vertical plane as illustrated in FIG. 4 for a single radiating element. Arms 21 and 22 support the rectangular slant dipole arms 23 and 24. A balun feed is achieved by bringing a coaxial line inside arm 22 with the center conductor 26 extending across the feed gap and connected to arm 21. The outer conductor of the coax is connected to arm 22. A vertical dipole with arms 27 and 28 is also connected to the balun. The two dipoles are excited in parallel by a common voltage, V.

The approach here is to control the phase of $E_\theta/E_\phi$ of equation (11) by the addition of the vertical dipole which has a different length than the slant dipole. Thus the phase of the impedance of and therefore the current in the vertical dipole will be different than that of the slant dipole. This additional vertical current will change both the magnitude and phase of the vertically polarized field ($E_\theta$). Thus by adjusting the length of the vertical dipole and the angle $\psi$ of the slant dipole we may exert considerable control over the magnitude and phase of $E_\theta/E_\phi$. This allows us to achieve a low axial ratio. The additional dipole could also be horizontal or at some other angle just so long as it is not parallel to the slant dipole. In fact the best orientation is to make it orthogonal (perpendicular) to the slant dipole since this eliminates the coupling between the two dipoles. The vertical orientation was chosen for illustrative purposes since it simplifies the following analysis.

Assume that the slanted half-wavelength dipole is tuned to be resonant and let its input impedance and current be $R_1$ and $I_1$ respectively. Let the input impedance and current of the shorter vertical dipole be $R_2+jX_2$ and $I_2$ respectively. We how have $$I_1=V/R_1 \tag{17}$$

$$I_2=\frac{V}{R_2+jX_2}=\frac{I_1R_1}{R_2+jX_2} \tag{18}$$

If we consider only broadside radiation ($\theta=90°$) then equation (11) becomes $$\frac{E_\theta}{E_\phi}=j\left[\frac{I_1\sin\psi+I_2}{I_1\cos\psi}\right]G=j\left[\frac{\sin\psi+\dfrac{R_1}{R_2+jX_2}}{\cos\psi}\right]G \tag{19}$$

or $$\frac{E_\theta}{E_\phi}=j\left[\frac{\sin\psi+\dfrac{R_1(R_2-jX_2)}{R_2^2+X_2^2}}{\cos\psi}\right]G \tag{20}$$

The phase, $\phi_b$, of the bracketed term is now $$\phi_b\simeq\tan^{-1}\left[\frac{-R_1X_2}{R_1R_2+(R_2^2+X_2^2)\sin\psi}\right] \tag{21}$$

If $\cos\psi$ is negative, then the sign of $\phi_b$ is changed. For short vertical dipoles the impedance has a dominant negative reactance component., i.e., $X_2>>R_2$. Equation (21) then becomes $$\phi_b\simeq\tan^{-1}\left[\frac{-R_1}{X_2\sin\psi}\right] \tag{22}$$

The vertical dipole impedance may be controlled by its length and the pitch angle $\psi$ adjusted such that $\phi_b$ is effectively the negative of $\phi_e$ given by (13) and that the magnitude of (20) is one. The analysis is approximate since it does not taken into account the coupling between the dipoles. The analysis for other dipole orientations is similar to the above. The curves of FIG. 3 show that a reduction of the phase error by, say 20°, allows a considerable reduction of the axial ratio. For example, for mode 1 with a mast circumference of 0.65 wavelengths the axial ratio is reduced from 5 to 1.5 db for a 20° correction. The range of $\phi_b$ depends upon the impedances as shown in equation (21) and is limited. Calculations for dipoles with a length to diameter ratio of 10 and $\psi=30°$ show that the maximum value of $\phi_b$ is about 20° for a dipole length of 0.2 wavelengths. Using 20° as the maximum correction of the phase error $\phi_e$ it is found in a manner like that used for equation (14) that $$M\geqq 0.39-0.07AR+(1.2-0.04AR)\beta\rho_1 \tag{23}$$

Using the previous example with $\beta\rho=0.304$ and $AR=0.5$ we find that $M\geqq 0.71$. Thus we can use mode 1. As can be seen from equation (10), two less dipoles are required for mode 1 than mode 2. The total length of the long and short dipole in each dipole assembly is 0.7 wavelengths which is significantly less than a wavelength. The phase of the currents in the vertical dipole may be changed 180° by interchanging the connections to the balun arms. The determination of the pitch angle of the slanted dipoles and the length of the shorter vertical dipoles for achieving a low axial ratio may be accomplished by experimental procedures.

To generalize and summarize then, we may place a short dipole in shunt with a slanted longer dipole so as to achieve a low axial ratio with a minimum total length of dipole. The short dipole has maximum effectiveness if the short dipole is orthogonal to the longer dipole and the current in the short dipole is in quadrature with the current in the longer dipole. This quadrature relationship is achieved by making the current in the longer dipole be in phase with or lag and the current dipole lead the phase of the common applied voltage. This phasing is accomplished by (1) making the length of the longer dipole equal to or approximately a half-wavelength or greater which means its impedance is purely resistive or its reactive component is inductive; and (2) making the length of the short dipole significantly less than a half-wavelength which means its impedance has a capacitive reactive component whose magnitude is made larger than the resistive component. This latter situation occurs when the length is less than 0.3 wavelengths for dipole length to diameter ratios on the order of 10. Thus the length of the short dipole is significantly less than a half-wavelength and the total length of the short and longer dipole is significantly less than one wavelength. The phase and magnitude of the ratio $E_\theta/E_\phi$ are then controlled predominantly by the length of the short dipole and the slant angle of the longer dipole respectively. Of course the ratio $E_\theta/E_\phi$ determines the axial ratio. Ideally, the short dipole should be orthogonal to the longer dipole but vertical short dipoles may be effectively used since the slant angle of the longer dipole is usually less than 40 degrees.

Figure 7:
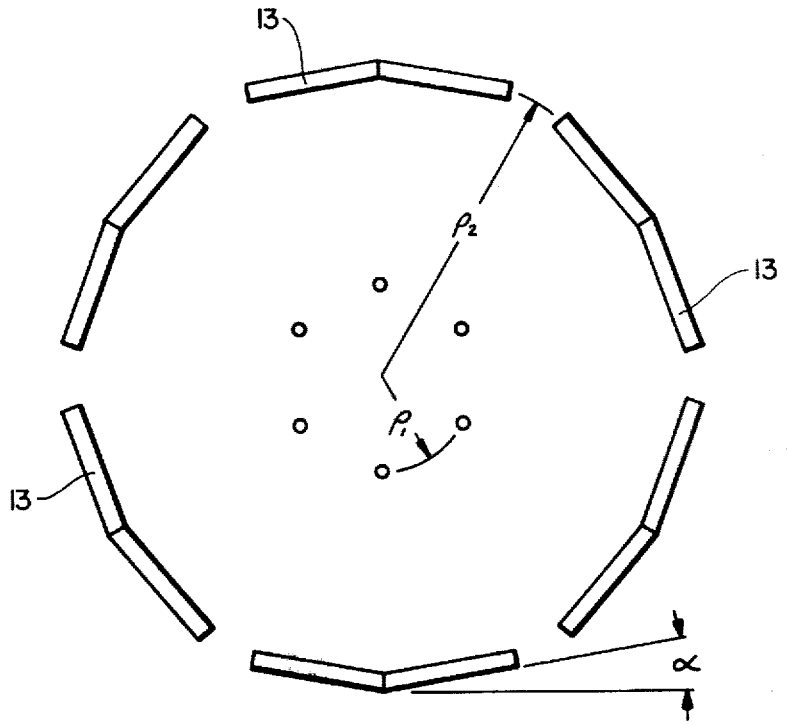
FIG. 7 shows a top view of a six element circular array of dipoles placed around a cylinder simulated by six vertical wires.

A Wire Antenna Computer Program was used to obtain results for half-wave dipoles placed around a conducting cyclinder. FIG. 7 shows a top view of one antenna model which consists of six half wave dipoles slanted at angle $\psi$ with respect to the horizontal axis and the two halves are bent back at an angle $\alpha$. The cylinder is approximated by six vertical wires. The cylinder diameter is small enough because of the phase error restriction, equation (13), that the circumferential currents are negligible. Computations were performed for modes 1 and 2 for several diameters of the ring array and number of elements and for cylinder diameters which gave phase errors less than 5°.

Figures 8A, 8B:
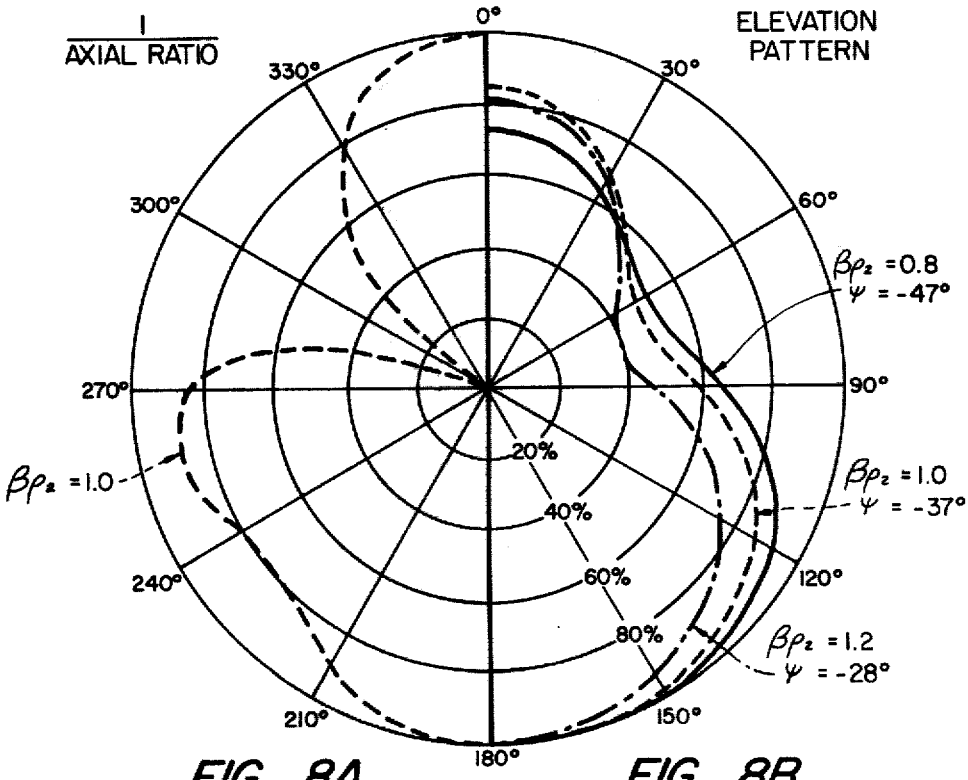
FIGS. 8A and 8B show computed axial ratio and elevation patterns respectively for a four element circular array of slanted dipoles operating in mode one for various diameters of the circular array.

FIG. 8A shows the axial ratio and 8B the elevation voltage pattern versus elevation angle for mode $M=1$ with four slanted dipoles with $\rho_1=0.08\lambda$ and $\alpha=22.5°$. For convenience the inverse of the axial ratio is plotted. Thus 50 percent corresponds to a 6 db axial ratio. The axial ratio is less than 2 db for elevation angles from the horizon to the nadir. The polarization changes from right hand to left hand as the elevation angle progresses from the horizon to the zenith. At an elevation angle of about 30° it is linear. The elevation patterns are shown in the right half of the figure for three array diameters. In each case the slant angle $\psi$ was calculated from equation (23) with the assumption of no cylinder present. The axial ratios for $\beta\rho_2=0.8$ and 1.2 were as good as or better than that for $\beta\rho_2=1$. The axial ratio could be improved by changing the slant angle by a small amount. The azimuth patterns at the horizon were omnidirectional within ±0.5 db.

Figure 9:
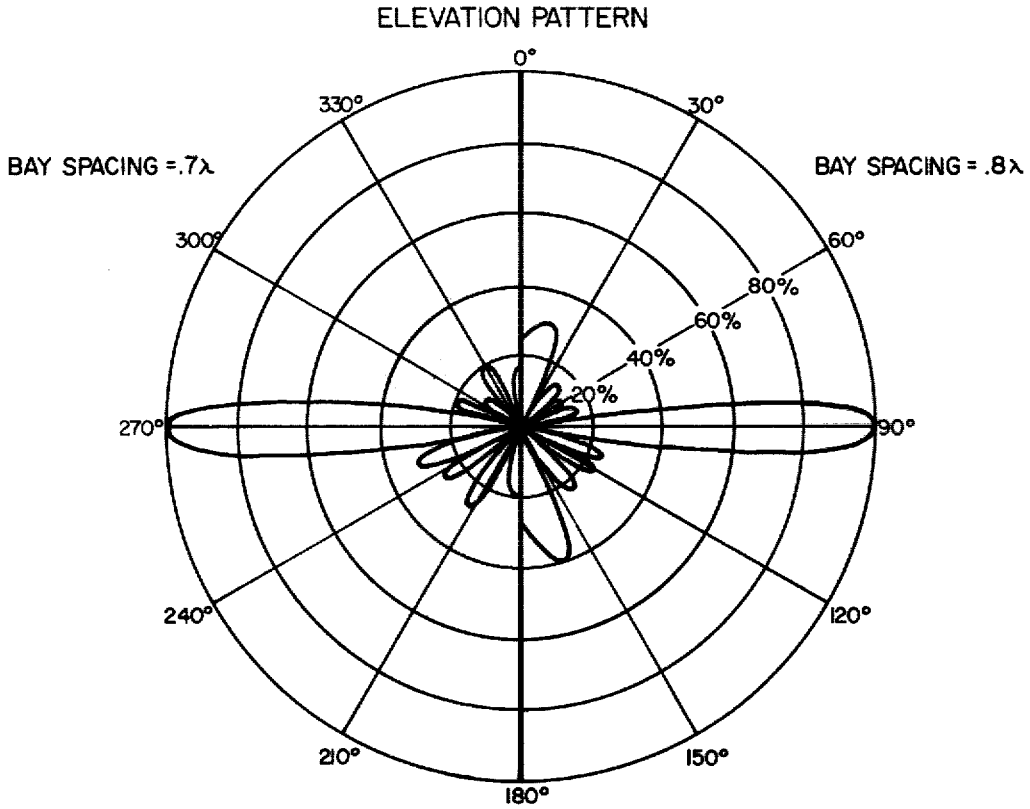
FIG. 9 shows computed elevation patterns for six bays of slanted dipoles, each bay consisting of four dipoles operating in mode one for two different bay spacings.

Notice that the radiation is stronger towards the nadir than the horizon. This happens because the dipoles are skewed, overlap somewhat and there is a 90° progressive phasing. The bay spacing is limited to a value less than one wavelength if strong radiation is not desired to the zenith and nadir. FIG. 9 shows the elevation patterns for a 6 bay array of four slanted dipoles for bay spacings of 0.7 and 0.8λ. The mode number is one, $\beta\rho_1=0.25$, $\beta\rho_2=1$ and $\alpha=22.5°$. It appears that a bay spacing of 0.8 should be satisfactory.

The use of dipoles longer than a half-wavelength for broadbanding purposes (such as wavelength dipoles) is not desirable because of degraded pattern characteristics. The overlap of the dipoles is much greater which leads to severe degradation of the single bay elevation pattern for modes greater than zero.

Figures 10A, 10B:
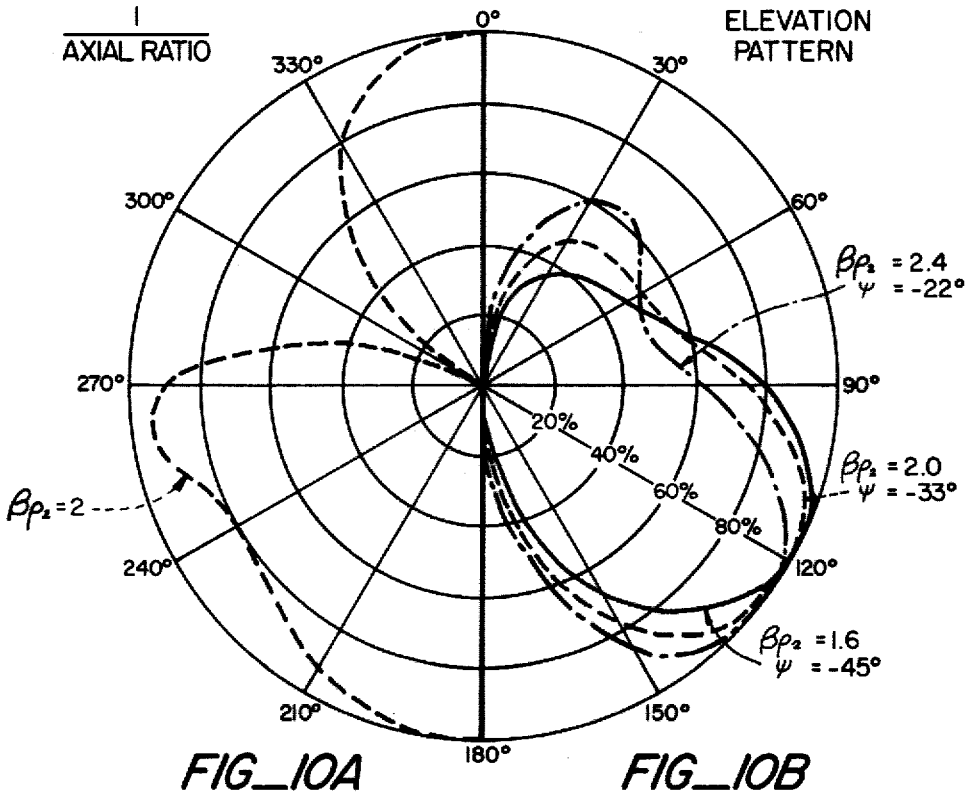
FIGS. 10A and 10B show computed axial ratio and elevation patterns respectively for an eight element circular array of slanted dipoles operating in mode two.

FIG. 10A shows the axial ratio and FIG. 10B the elevation patterns for mode 2 for a single bay with cylinder diameter equal to 0.21λ and $\alpha$ equal to 22.5°. In this case the axial ratio is less than 1.8 db from the horizon to the nadir. The aximuth patterns were omni within ±0.1 db. The elevation patterns have nulls at the zenith and nadir. Thus bay spacings of one wavelength may be used. Computations were also performed for a six element array for mode 2 with $\beta\rho_2=2$. In general, the performance was about the same as for the eight element array except that the azimuth pattern was omni within ±0.8 db. The choice of six or eight would depend upon the type of feed network desired, i.e., 120° or 90° progressive phasing and wind loading allowances.

Some control of the azimuth pattern may be achieved by a combination of modes M and −M without degrading the axial ratio. Each of the modes has the same sense of polarization and the same dipole impedance when mutual coupling is taken into account. The elevation patterns of FIGS. 8 and 10 would be reversed from top to bottom for modes −1 and −2 respectively. The azimuth patterns are given by $$E(\phi)=a_M e^{jM\phi}+a_{-M}e^{-jM\phi} \tag{24}$$

where $a_M$ and $a_{-M}$ are the complex excitations of the two modes. The feed network for each becomes more complicated because unequal power splits are required.

In general, it is not possible to add other modes without degrading the axial ratio (since the slant angle is different) and causing the input impedances of the dipoles to be different.

In the previous sections we have described rather thin dipoles which may not have a low enough Q to satisfy the stringent VSWR requirements for some television broadcast applications. We may obtain lower Q radiators by using thicker dipoles or grids of rods to simulate thick dipoles. The dipoles may be straight, bent back, curved, etc. just so they give radiation equivalent to a slanted dipole. Care must be taken in choosing the metal support structures and baluns for the dipoles. In the Lindenblad antennas, the horizontal support structures for the dipoles are in a null electrical field because of the mode number zero. For the higher order modes, the support structures are not in null fields. Thus the currents excited on these structures may radiate fields which degrade the axial ratio of the antenna. It may be necessary to place chokes on these support structures.

Figure 11A:
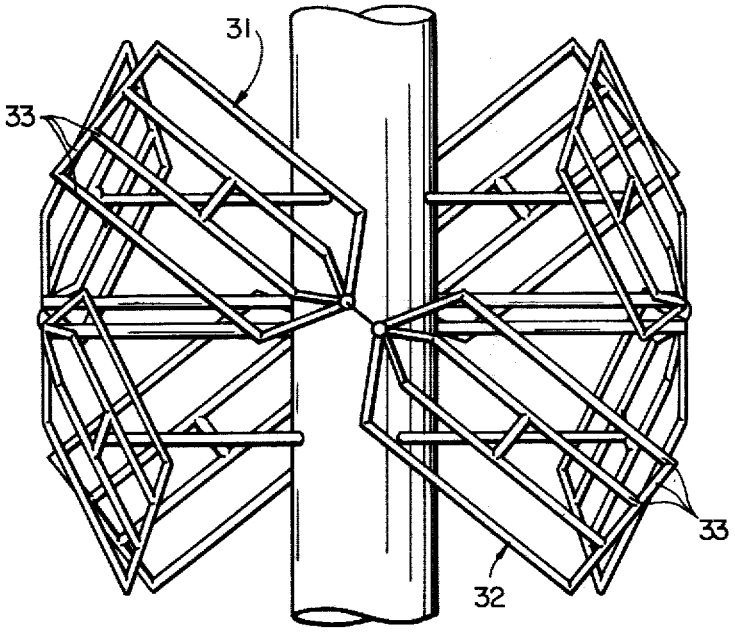
FIGS. 11A and 11B show top and front views of a broadband dipole which could be used for a channel 2 TV broadcast antenna.
Figure 11B:
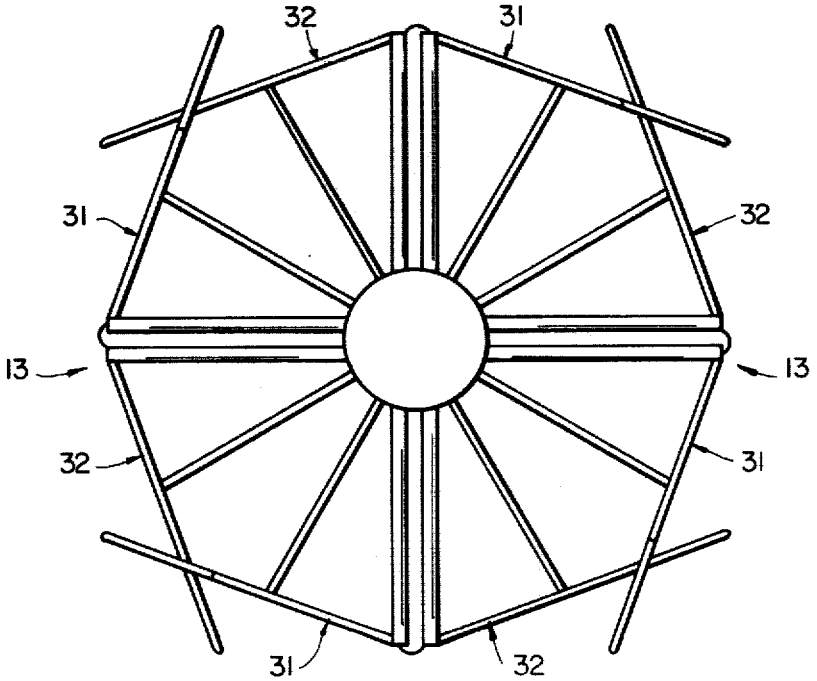

A dipole design for very wide bandwidths is shown in FIGS. 11A and 11B wherein each half 31 and 32 of the dipole 13 is formed by four rods 33. This design could be used to cover a major portion of the FM band or several adjacent TV channels. The dipole is fed by a conventional 1:1 balun and compensating $\lambda/4$ shunt stubs are used for impedance compensation. The art or science of designing thick dipoles to have a 1.1:1 VSWR over a ten percent band is well known at this time. The design of four dipoles operating in mode $M=1$ is somewhat more involved because of the mutual coupling between the dipoles. However, this can be handled by careful engineering procedures as follows. First, a dipole configuration is chosen that has good broad-band properties (low Q) in an isolated environment. Then several design procedures are available. First, measure the self and mutual impedances in the array environment. Then design matching circuits for the dipoles taking into account the mutual impedances. The circuit will be the same for each dipole because of rotational symmetry. The second is to measure the impedances of the dipoles in their real environment and then design the matching networks. The real environment is feeding the dipoles with the proper voltages by means of padded lines, Wilkinson power dividers or hybrid circuits. The design of the dipoles for mode 2 with six to eight dipoles follows in a similar manner.

For mode 1 with four dipoles the desired phasing is 0, 90, 180 and 270 degrees. The 180° phasing of opposite dipoles may be achieved by running the coax feeds into opposite sides of the baluns. The quadrature phasing of the two pairs of dipoles may be achieved by line lengths or a quadrature hybrid. In the latter case the audio and visual transmitters may be combined into the antenna. One will operate in mode 1 and the other in mode −1.

Figure 12:
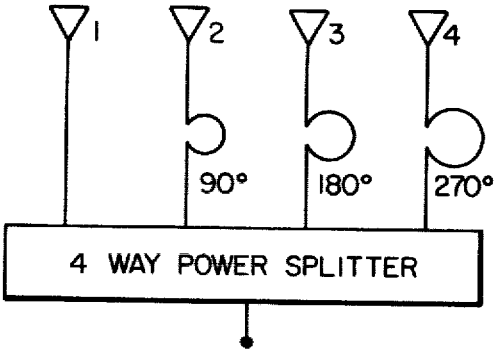
FIGS. 12, 13 and 14 are schematic diagrams of bay feed networks for modes one and two.
Figure 13:
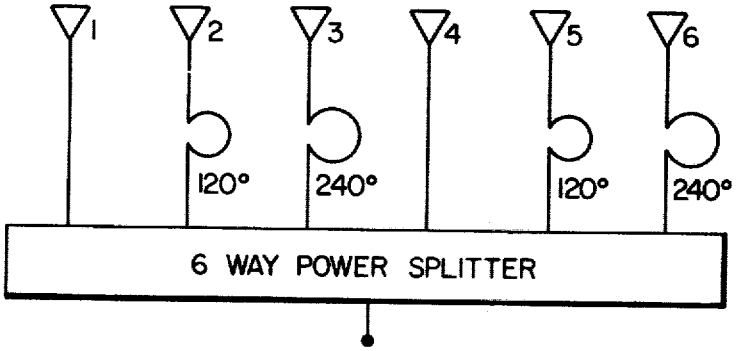
Figure 14:
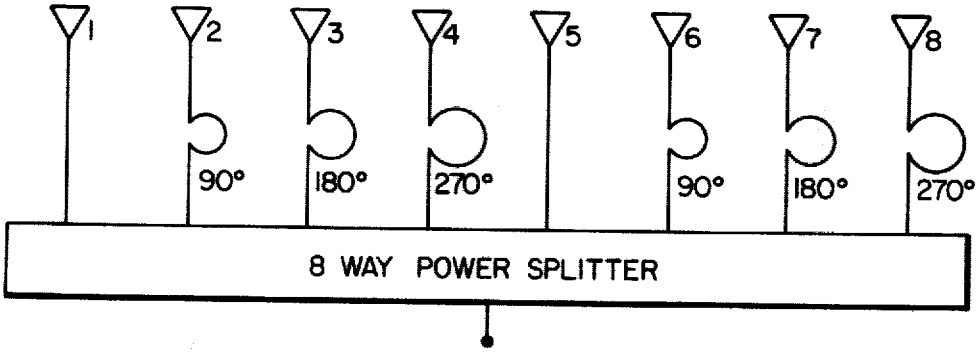

FIGS. 12, 13 and 14 show the schematic diagrams for several feed networks for modes −1 and −2. FIG. 12 is for a four dipole array and consists of four-way power splitter and line length delays. Symmetrical reflections from the dipoles are reflected back to the single feed point where they produce zero voltage. Hence, they are reflected again and appear at the dipoles as mode 1. The radiation from these reflections distorts the azimuth pattern in the form of two nulls. There is no degradation of the axial ratio.

For FIG. 13 with $N=6$ and $M=-2$ the reflected waves appear as mode zero. This produces two nulls in the azimuth pattern plus degradation of the axial ratio. For $N=8$ and $M=-2$ in FIG. 14, the reflected wave is in mode 2 which produces four nulls in the azimuth pattern but no degradation of the axial ratio.

Thus it is seen that the feeds provide reflection cancellation allowing a low VSWR at the input but at the expense of degradation of the azimuth pattern and in some cases the axial ratio. Of course, if Wilkinson power dividers were used, the antenna reflections would be absorbed in the dividers. Similar results may be obtained for the higher order modes.

Two or more bays of slanted dipole assemblies may be arrayed vertically and fed in phase with equal powers to increase the antenna gain and reduce the elevation beamwidth. Beam tilt and null-fill may be achieved by conventional techniques consisting of small changes in the phase and/or power in each bay.

A novel approach for achieving circular polarization from a circular array of slanted dipole assemblies placed around a conducting cylinder or tower has been described. For television channels 2 through 6, modes 0, 1 or 2 can be used for most applications. For mode 1 and an axial ratio of one db the maximum cylinder diameters with and without short vertical dipoles are 0.19 and 0.08 wavelengths respectively. For channels 7 through 13, modes 2 or 3 would usually be used. For mode 2 and an axial ratio of one db the maximum cylinder diameters with and without short vertical dipoles are 0.46 and 0.31 wavelengths respectively. At channel 11 the diameters are approximately 27" and 18".

Two design examples are given in the following. Consider first a channel 4 requirement with a CP gain of 4, an axial ratio of 0.5 db and a circularity of 2 db.

An eight wavelength aperture of 114 feet is required to achieve the gain. The base diameter of the support mast is 24" (the diameter may be reduced with height). Thus we find $\beta\rho_1=0.44$. From equations (14) and (21) it is found that M must be greater than 1.36 and 0.88 without and with short vertical dipoles respectively. Thus use mode 1 with short vertical dipoles since this reduces the total number of dipoles in the array. The short dipoles will be about 0.15 wavelengths long. The total length of the half-wave dipole and short dipole in the dipole assembly is then 0.65 wavelengths. Choose the spacing of the depoles from the cylinder to be one eighth of a wavelength. Thus, $\beta\rho_2=1.22$. Then from equation (10) we find $N\geqq 3.94$. Thus use four dipole assemblies in each bay with a progressive phasing of 90°. Using equation (23) the pitch angle is found to be 30°. Ten bays with a spacing of 0.8 wavelengths are used to fill the 8 wavelength aperture. If we had used mode 2 without the vertical dipoles, then we find that eight bays of six dipoles each with a bay spacing of one wavelength are required. This arrangement has 48 dipoles compared to 40 for the above.

Consider next a channel 11 requirement with a CP gain of 8, an axial ratio of 0.5 db and a circularity of 3 db. A sixteen wavelength aperture of 79' is required to achieve the gain. This requires a base diameter of the mast of 16" which results in $\beta\rho_1=0.84$. To determine the mode number we find from equation (14) that $M\geqq 1.93$. If we use short vertical dipoles it is found from equation (21) that $M\geqq 1.34$. since this does not allow a lower mode number we set $m=2$ and use slant dipoles without the short vertical dipoles. It is found from equation (14) that this allows an axial ratio of 0.2 db. We set $\rho_2-\rho_1=0.2$ wavelengths. It follows then that $\beta\rho_2=2.1$. It is found from equation (100) that $N\geqq 5.89$. Thus use six dipoles in each by with a progressive phasing of 120°. The pitch angle is calculated from equation (23) to be 29°. Sixteen bays of these slanted dipole arrays with one wavelength spacing are used to form the complete antenna.

What is claimed is:

1. A circularly polarized antenna comprising an elongated support having a conductive outer surface; at least one circular array of radiating elements where the number of radiating elements N is at least three, each of said radiating elements comprising a long dipole at a slant angle with respect to a plane perpendicular to the elongated support and said plane passing through the mid points of said long dipoles and a short dipole connected to said long dipole and fed in parallel with said long dipole and disposed at an angle with respect to the long dipole, said short dipole having a length substantially less than one-half wavelength at the operating freqency and said long dipole having a length of approximately one-half wavelength at the operating frequency; said long dipole and said short dipole each comprising first and second sections extending away from said plane and first and second support means extending outwardly from said support and engaging the ends of said first and second sections respectively at said plane and means for feeding the supported ends of said radiating elements in each circular array with voltages of equal amplitude and progressive phase shift of $2\rho M/N$ radians where M is the mode number.

2. A circularly polarized antenna as in claim 1 wherein said short dipole has a length less than 0.3 wavelengths at the operating frequency.

3. A circularly polarized antenna as in claim 1 where $$M \geqq 0.39 - 0.07AR + (1.2 - 0.04AR)\beta\rho_1$$

where

AR = axial ratio in db $\beta = 2\pi/\lambda$ $\rho_1$ = radius of support.

4. A circularly polarized antenna as in claim 3 where $$N \geqq 2.1 + 2.25M - 0.25CM/w_2$$

where C is the circularity defined by $$C = 20 \log_{10}\left[\frac{J_M(w_2) + J_{M-N}(w_2)}{J_M(w_2) - J_{M-N}(w_2)}\right]$$

and $J_M(w_2)$ = Bessel Function of the first kind $J_{M-N}(w_2)$ = Bessel Function of the first kind M = mode number N = number of dipoles $w_2 = \beta\rho_2 \sin\theta$ $\beta = 2\pi/\lambda$ $\rho_2$ = radius of circle of dipoles.

5. A circularly polarized antenna as in claim 4 where the slant angle $\psi$ is given by $$\psi = \tan^{-1}\left|\frac{1}{G}\right|$$

-continued $$G = \frac{H_M^{(2)\prime}(w_1)}{H_M^{(2)}(w_1)}\left[\frac{J_M(w_2)N_M(w_1) - J_M(w_1)N_M(w_2)}{J_M'(w_2)N_M'(w_1) - J_M'(w_1)N_M'(w_2)}\right]$$

and $J_M(w)$ = Bessel Function of the first kind $N_M(w)$ = Bessel Function of the second kind $H_M^{(2)}(w) = J_M(w) - jN_M(w)$ and the prime represents the derivative of the Bessel Function M = mode number $w_1 = \beta\rho_1 \sin\theta$ $\beta = 2\pi/\lambda$ $\rho_1$ = radius of support $w_2 = \beta\rho_2 \sin\theta$ $\rho_2$ = radius of circle of dipoles $\theta$ = direction of main beam

6. A circularly polarized antenna as in claim 5 including a plurality of bays spaced from one another along the support and fed substantially in phase to provide broadside radiation.

7. A circularly polarized antenna comprising an elongated support having a conductive outer surface; at least one circular array of radiating elements where the number of radiating elements N is at least three, each of said radiating elements comprising a long dipole at a slant angle $\psi$ with respect to a plane perpendicular to the elongated support, said long dipole having a length of approximately one-half wavelength at the operating frequency so that its impedance is resistive or if it has a reactive component the component is inductive, and a short dipole connected to said long dipole at the center of each dipole and fed in parallel with said long dipole and disposed at an angle with respect to the long dipole, said short dipole having a length such that at the operating frequency its impedance has a reactive component which is capacitive and much larger than the resistive-inductive component of the short dipole, and means for feeding the radiating elements in each circular array with voltages of equal amplitude and progressive phase shift of $2\pi M/N$ radians where M is the mode number.

8. A circularly polarized antenna as in claim 7 wherein said short dipole has a length less than 0.3 wavelengths at the operating frequency.

* * * * *